US009532645B1

(12) United States Patent
Lin

(10) Patent No.: US 9,532,645 B1
(45) Date of Patent: Jan. 3, 2017

(54) VARIABLE HEIGHT TABLE

(71) Applicant: Zhuhai Shichang Metals Ltd., Zhuahi (CN)

(72) Inventor: Wen-Sheng Lin, Kaohsiung (TW)

(73) Assignee: Zhuhai Shichang Metals, Ltd. (CN)

( * ) Notice: Subject to any disclaimer, the term of this patent is extended or adjusted under 35 U.S.C. 154(b) by 0 days.

(21) Appl. No.: 14/955,590

(22) Filed: Dec. 1, 2015

Related U.S. Application Data

(63) Continuation-in-part of application No. 29/542,872, filed on Oct. 19, 2015, and a continuation-in-part of application No. 29/542,882, filed on Oct. 19, 2015, now Pat. No. Des. 764,206.

(51) Int. Cl.
*A47B 3/02* (2006.01)
*A47B 9/16* (2006.01)
*A47B 13/08* (2006.01)

(52) U.S. Cl.
CPC *A47B 9/16* (2013.01); *A47B 13/08* (2013.01)

(58) Field of Classification Search
CPC ..... A47B 3/02; A47B 2003/025
USPC ..... 108/119, 118, 120, 117; 248/164, 432, 248/431, 434, 188.6
See application file for complete search history.

(56) References Cited

U.S. PATENT DOCUMENTS 346,145 A * 7/1886 Bunce ..... D06F 81/04 108/117
544,603 A 8/1895 Thompson
2,675,286 A 4/1954 Derman
2,968,059 A 1/1961 Munson
3,094,948 A * 6/1963 Clow ..... A47B 9/16 108/10
3,906,848 A * 9/1975 Gow ..... A47J 37/0871 108/115
4,168,669 A * 9/1979 Arnoff ..... A47B 9/16 108/116
4,763,865 A * 8/1988 Danner ..... F16M 11/38 108/118
4,850,286 A * 7/1989 Cline ..... A47B 23/046 108/118
4,970,968 A 11/1990 Mattesky
D314,878 S * 2/1991 Hart ..... D6/691.3
D331,505 S * 12/1992 Sylvester ..... 108/119
5,299,510 A 4/1994 Mattesky
7,059,254 B2 6/2006 Strong et al.
7,263,932 B2 9/2007 Winter et al.
7,640,869 B2 * 1/2010 Leng ..... A47B 3/02 108/116

(Continued)

*Primary Examiner* — Jose V Chen
(74) *Attorney, Agent, or Firm* — Luedeka Neely Group, P.C.

(57) ABSTRACT

A folding table movable between a folded position and a plurality of upright positions is disclosed. Each of the upright positions corresponds to a different table height. The folding table includes a table top and a scissor-folding table base assembly having first and second legs. The second leg is slidably retained adjacent a lower surface of the table top, and the first and second legs are pivotably connected to one another to form an X-shape. A clamp having a plurality of retaining notches retains the second leg against the lower surface of the table top. Movement of the second leg from a first retaining notch to a second notch causes the table to move from a first to a second upright position, having a different tabletop height. The table legs may also be collapsed into a folded position.

18 Claims, 5 Drawing Sheets

(56) References Cited

U.S. PATENT DOCUMENTS

2013/0284077 A1* 10/2013 Copeland ..... A47B 3/00
108/117

* cited by examiner

VARIABLE HEIGHT TABLE

CROSS-REFERENCE TO RELATED APPLICATIONS

This application is a continuation-in-part of co-pending design patent application Ser. Nos. 29/542,872 and 29/542,882, both filed Oct. 19, 2015. The disclosures of both applications are herein incorporated by reference.

FIELD

This disclosure relates to folding tables. More particularly, this disclosure relates to folding tables which may be configured for use at a variety of differing table top heights.

BACKGROUND

It is at times desirable to have a small table to use in the performance of certain tasks. For instance, a small table may be useful for eating, reading, writing, or working with a computer. However, the optimal table top height for the performance of each of these tasks may not be the same. Certain tasks may be more preferably performed on a taller table while other tasks are more preferably carried out using a somewhat shorter table. Moreover, it is also desirable to have a table whose legs fold up for storage when the task or tasks are completed.

Thus, there for a folding table for personal use, which may be configured for use at a plurality of differing table top heights.

SUMMARY OF THE INVENTION

The above and other needs are met by a variable height table according to the current disclosure. According to one embodiment, the variable height table includes a table top having an upper surface and a lower surface and a table top height.

The variable height table also includes a scissor-folding table base assembly having a first leg and a second leg. The first and second legs each have an elongate diagonal member, an upper cross-member attached to a first end of the elongate diagonal member, and a lower foot member attached to a second end of the elongate diagonal member. The first leg upper cross-member is fixedly rotatably connected to the lower surface of the table top, the second leg upper cross-member is slidably retained adjacent the lower surface of the table top, and the first and second legs are pivotably connected to one another, at a position on each leg between the first and the second ends of the legs, so as to form an X-shape.

The variable height table also include a clamp, having a plurality of retaining notches for retaining the second leg upper cross-member, and biased against the lower surface of the table top by a spring.

Movement of the table's second leg upper cross-member from a first of the retaining notches to a second of the retaining notches causes the legs to pivot relative to one another and varies the table top height from a first height to a second height.

In another aspect, the present disclosure provides a folding table which is movable between a folded position and a plurality of upright positions. Each of the upright positions corresponds to a different table height. According to one embodiment, the folding table includes a table top having an upper surface and a lower surface and table top height.

The folding table also includes a scissor-folding table base assembly having a first leg and a second leg. The first and second legs each have an elongate diagonal member, an upper cross-member attached to a first end of the elongate diagonal member, and a lower foot member attached to a second end of the elongate diagonal member. The first leg upper cross-member is fixedly rotatably connected to the lower surface of the table top, the second leg upper cross-member is slidably retained adjacent the lower surface of the table top, and the first and second legs are pivotably connected to one another, at a position on each leg between the first and the second ends of the legs, so as to form an X-shape.

The folding table also include a clamp, having a plurality of retaining notches for retaining the second leg upper cross-member, and biased against the lower surface of the table top by a spring.

Movement of the folding table's second leg upper cross-member from a first of the retaining notches to a second of the retaining notches causes the table to move from a first upright position, having a first tabletop height, to a second upright position, having a second tabletop height. Removal of the folding table's second leg upper cross-member from all of the retaining notches allows the legs of the table base assembly to collapse into a folded position.

In certain embodiments of the disclosure, the table top preferably includes a blow-molded plastic member.

In certain embodiments of the disclosure, the table top upper surface preferably has a D-shape.

In certain embodiments of the disclosure, each foot member preferably includes a first end and a second end and is attached to the diagonal member only at the first end of the foot member.

In certain embodiments of the table, each foot member preferably includes a first end and a second end and is attached to the diagonal member at a point located between the two ends of the foot member.

In certain embodiments of the disclosure, the first and second legs are preferably each formed from tubular metal.

In certain embodiments of the disclosure, the foot members preferably each have a width which is greater than the width of the tabletop.

In certain embodiments of the disclosure, the first leg is preferably fixedly rotatably connected to the lower surface of the table top by one or more retainers which are molded into the lower surface of the table top.

In certain embodiments of the disclosure, the first leg is preferably fixedly rotatably connected to the lower surface of the table top by one or more retainer brackets which are fastened to the lower surface of the table top.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

According to the present disclosure, a variable-height, folding table is provided. The folding table is movable between a folded position and a plurality of upright positions. Each of the upright positions corresponds to a different table height.

Figure 1:
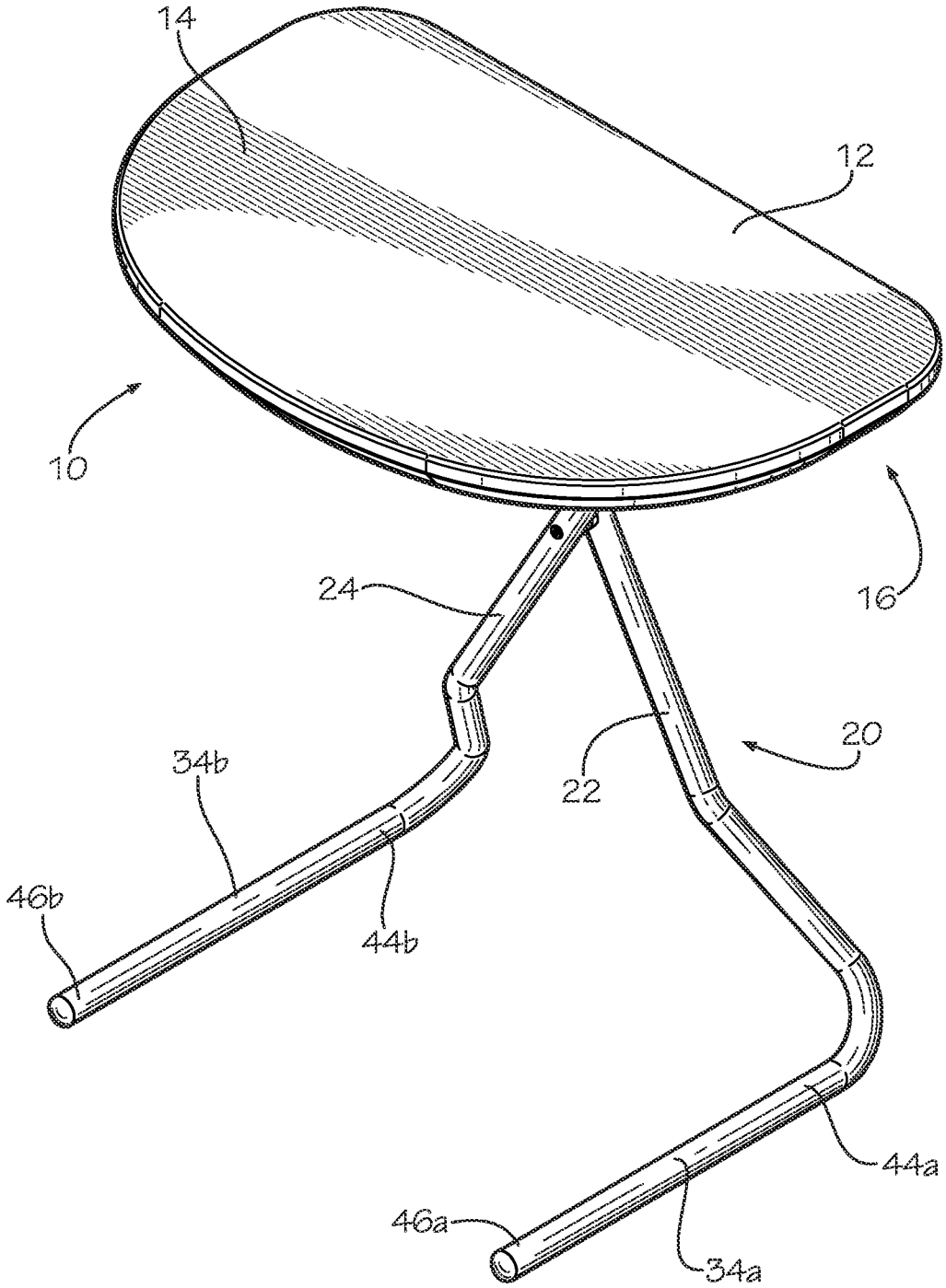
FIG. 1 is a top perspective view of a variable height folding table according to one embodiment of the present disclosure.
Figure 2:
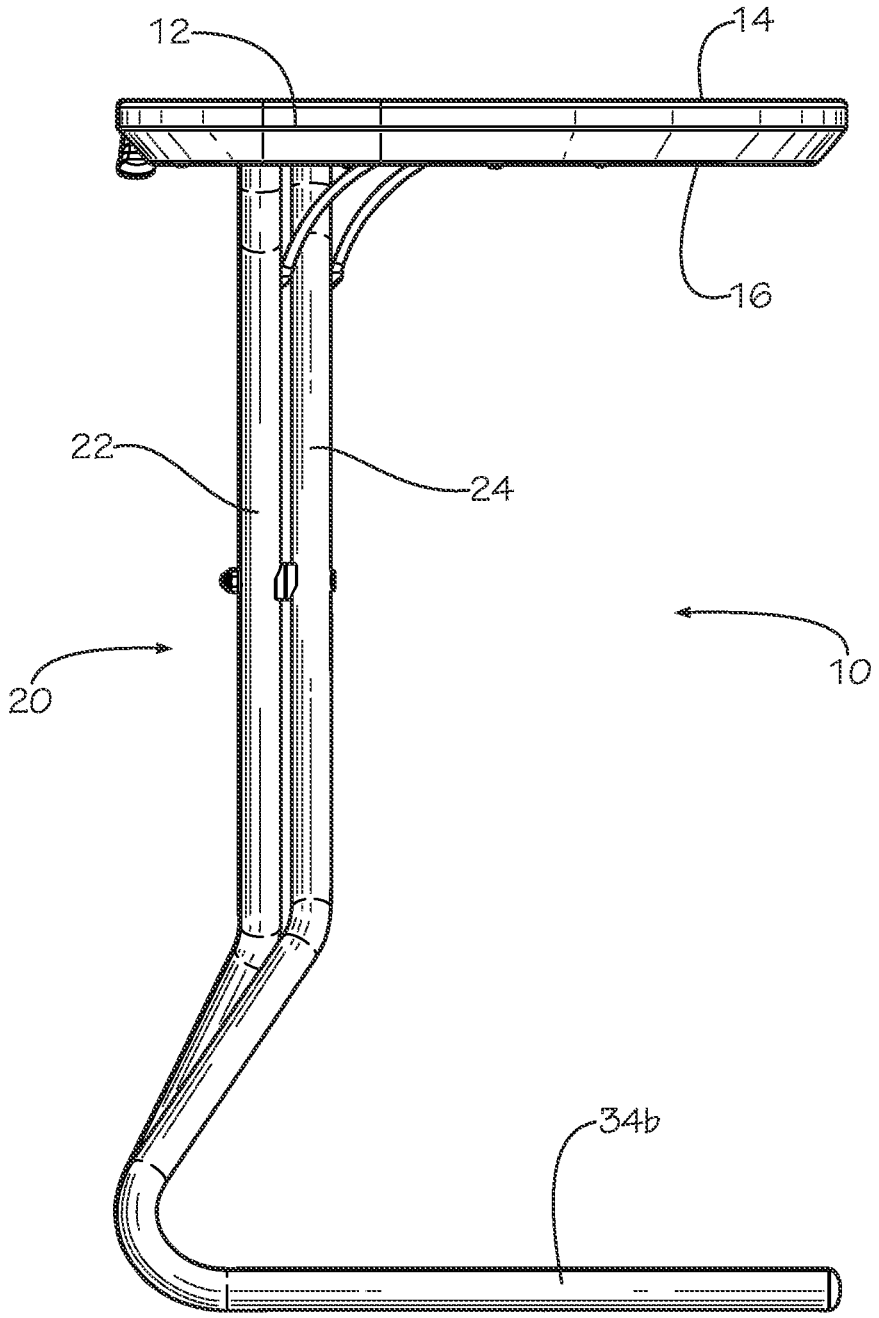
FIG. 2 is a side elevation view of a variable height folding table according to one embodiment of the present disclosure.
Figure 3:
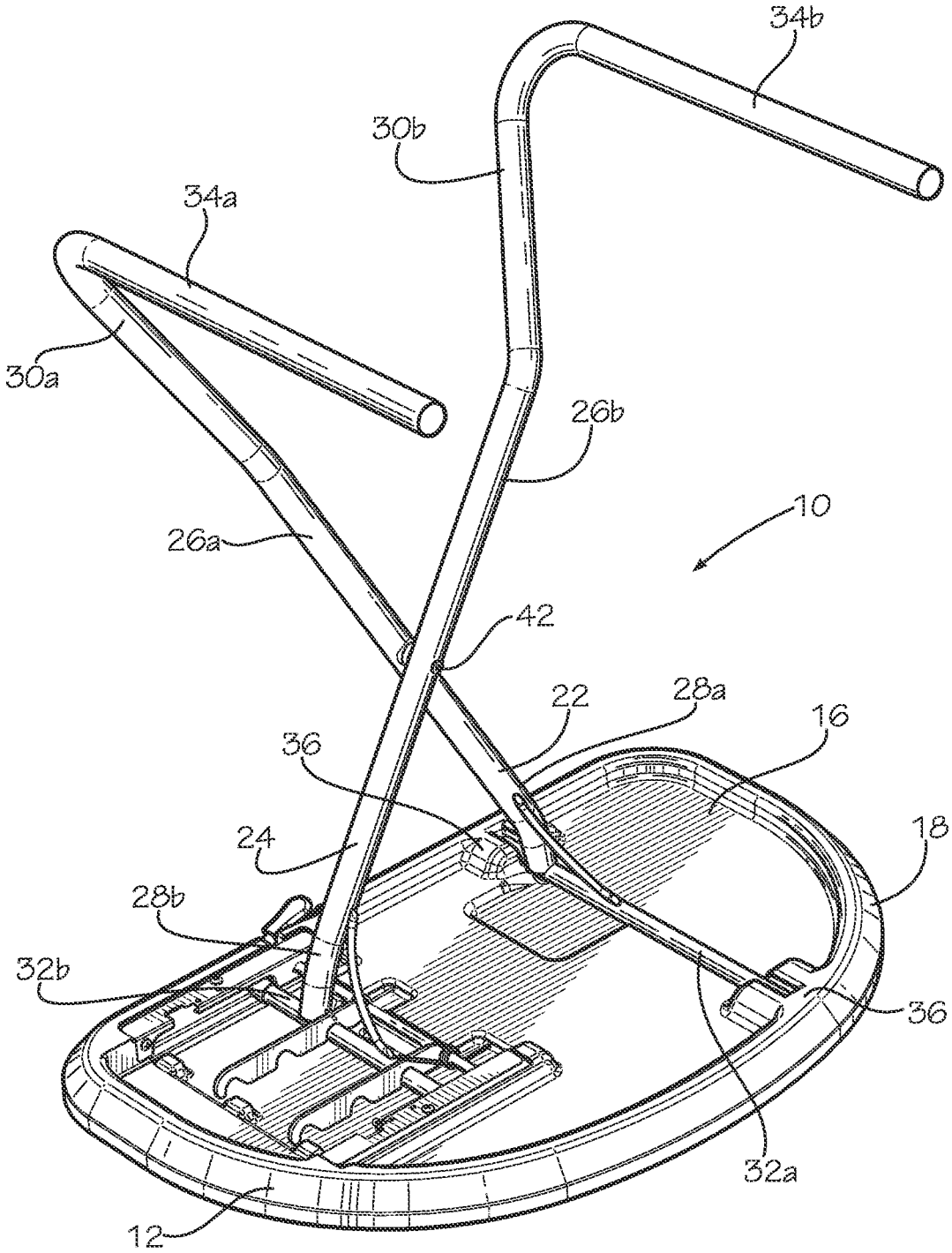
FIG. 3 is a bottom perspective view of a variable height folding table according to one embodiment of the present disclosure.

As shown in FIGS. 1-3, the folding table 10 includes a table top 12 having an upper surface 14 and a lower surface 16 and a table top height. The upper surface 14 is generally smooth, but a pattern or texture may be formed in the upper surface 14 if desired.

The table top 12 is generally sized for personal use by a single individual. Thus, the table top 12 may in preferably have length of from about 24 to about 30 inches and a width of from about 18 to about 20 inches. In certain embodiments of the disclosure, the table top upper surface 14 is generally "D-shaped" when viewed from above. Thus, one side of table top 12 may be curved along its outer edge, with the remaining sides of the table having generally straight edges.

Significantly, at least a portion of the table top 12 is preferably provided as a blow-molded plastic member 18. More preferably, substantially the entire table top 12 is provided by as a single blow-molded plastic member. This blow-molded plastic member 18 will generally have a substantially hollow interior in order to reduce the overall weight of the folding table. In order to provide additional strength and rigidity to the hollow, molded plastic member 18, a pattern of ribs or other shapes may be formed into the molded lower surface 16 of the table top 12.

The variable height table also includes a scissor-folding table base assembly 20. This base assembly 20 includes a first leg 22 and a second leg 24. The first and second legs 22, 24 each have elongate diagonal members 26*a*, 26*b* and each of the elongate diagonal members 26*a*, 26*b* have first ends 28*a*, 28*b* and second ends 30*a*, 30*b*. Upper cross-member 32*a*, 32*b* are attached to respective first ends 28*a*, 28*b* of each of the elongate diagonal member 26*a*, 26*b*. A bracket or other bracing may also be included in order to reinforce the connection between the respective diagonal members 26*a*, 26*b* and the upper cross-members 32*a*, 32*b*.

In addition, lower foot members 34*a*, 34*b* are attached to the respective second ends 30*a*, 30*b* of each of the elongate diagonal members 26*a*, 26*b*. In certain embodiments, the first and second legs 22, 24 are preferably each formed from tubular metal. In general, the first and second legs 22, 24 each preferably have an overall length of from about 42 to about 45 inches.

The first leg upper cross-member 32*a* is fixedly rotatably connected to the lower surface 16 of the table top 12. In some embodiments, the first leg 22 is preferably fixedly rotatably connected to the lower surface 16 of the table top 12 by one or more retainers 36 which are molded into the lower surface 16 of the table top 12. In other embodiments, however, the first leg is preferably fixedly rotatably connected to the lower surface 16 of the table top 12 by one or more retainer brackets which are fastened to the lower surface 16 of the table top 12.

Figure 5:
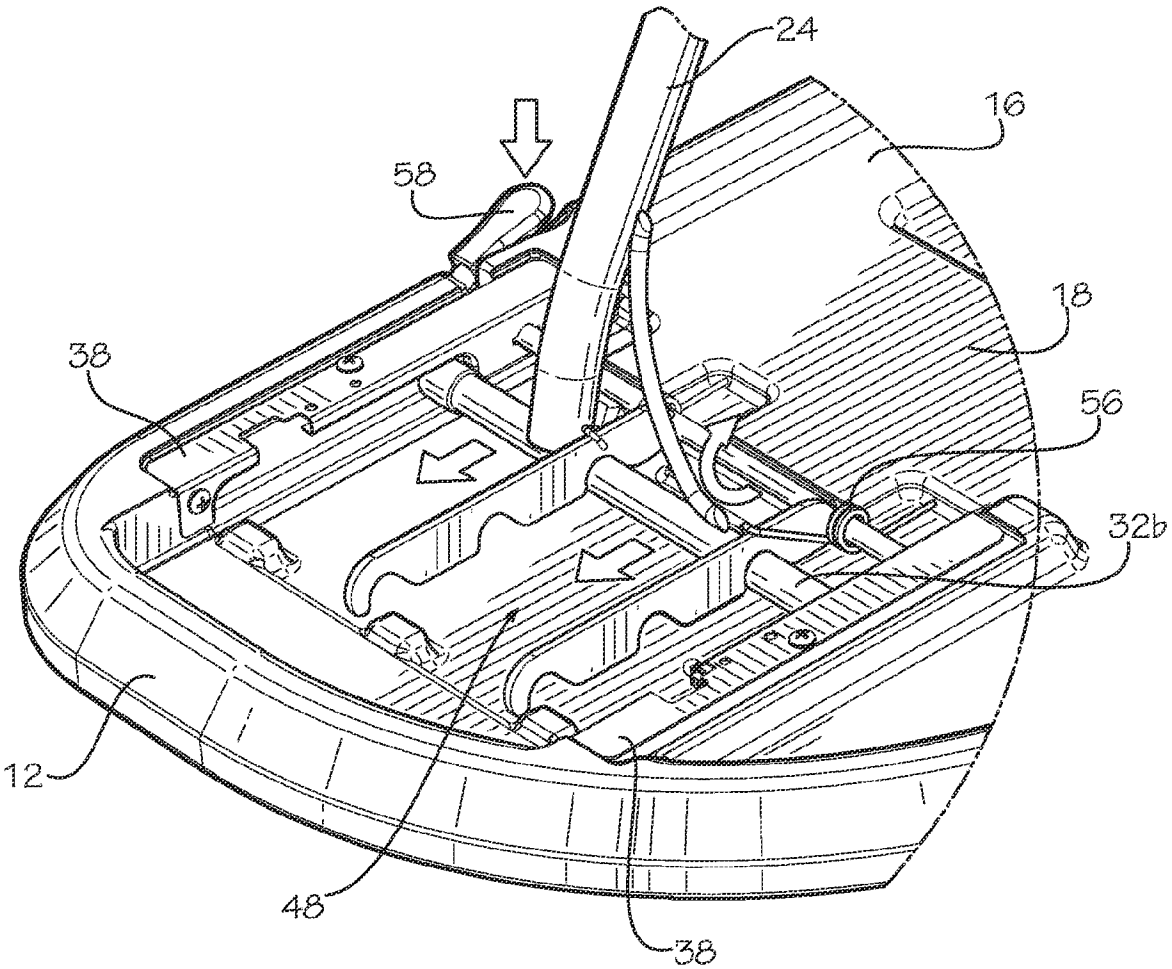
FIG. 5 is an additional perspective view of a portion of a variable height folding table cording to one embodiment of the present disclosure.

The second leg upper cross-member 32*b* is slidably retained adjacent the lower surface 16 of the table top 12. For instance, the ends of the second leg upper cross-member 32*b* may be held within a pair of tracks 38 which are attached to the lower surface 16 of the table top 12, as shown in FIG. 5. Preferably, each of the tracks 38 includes a gap 40 through which the ends of the second cross-member 32*b* may be inserted or removed from the tracks 38, as also shown in FIG. 5.

The first and second legs 22, 24 are also pivotably connected to one another by a pin 42, at a position on each leg between the first and the second ends of the legs, generally approximately midway along the length of each of the first and second legs 22, 24. Being pivotably connected in this matter, the first and second legs 22, 24 together form an X-shape.

In general, the foot members 34*a, b* of each leg also include first ends 44*a*, 44*b* and second ends 46*a*, 46*b*. The foot members 34*a*, 34*b* are generally attached to the diagonal members 26*a*, 26*b* of the legs only at the first ends 44*a*, 44*b* of the respective foot members 34*a*, 34*b*. Alternatively, however, each of the foot members 34*a*, 34*b* may be attached to the respective diagonal members 26*a*, 26*b* at a point located between the two ends of the foot members. As with the leg members, the foot members are each preferably formed from tubular metal.

In certain embodiments of the disclosure, the foot members 34*a*, 34*b* preferably each have a width which is greater than the width of the table top 12 in order to improve the stability of the table 10.

Figure 4:
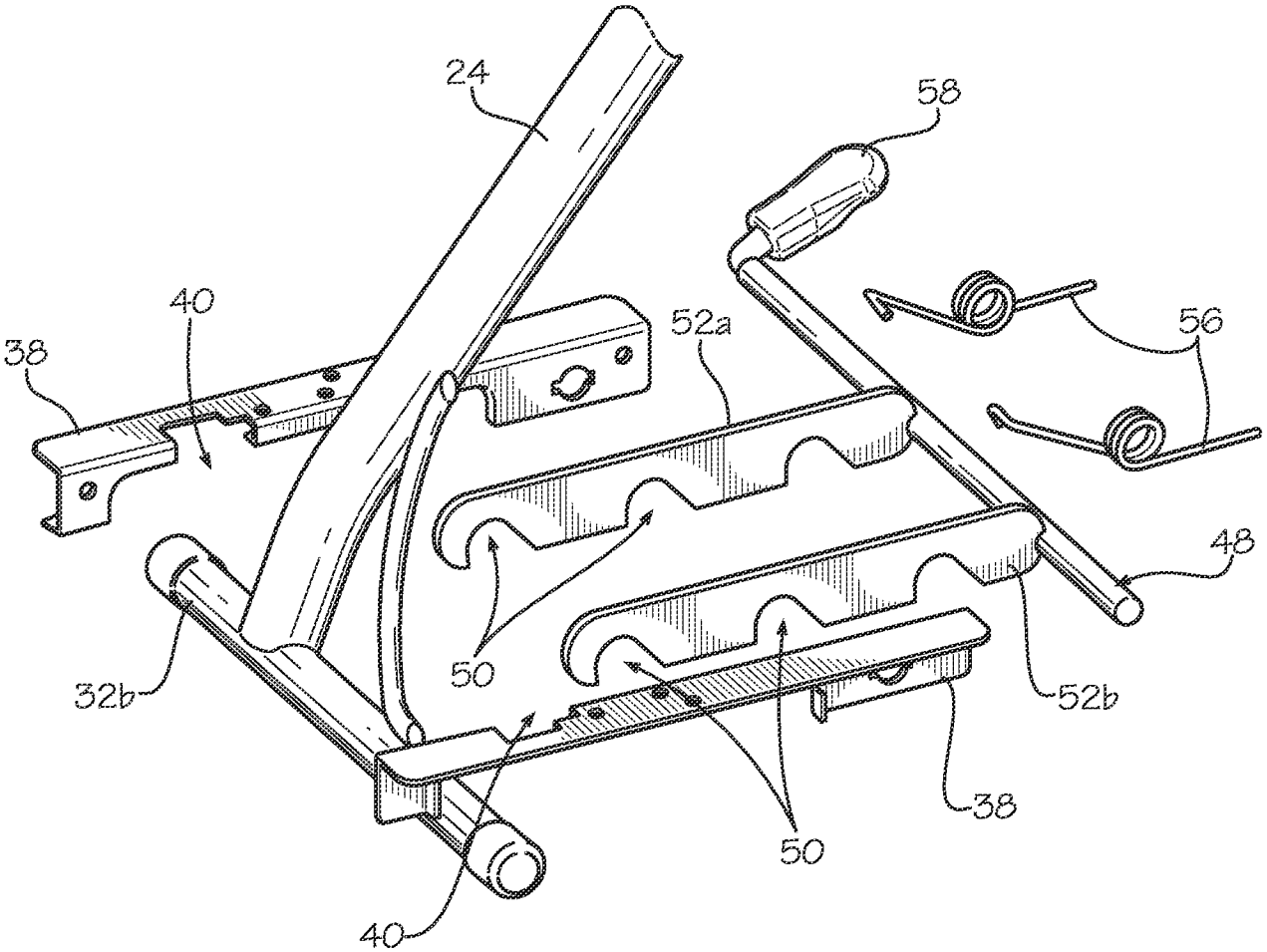
FIG. 4 is an assembly view of a portion of a variable height folding table according to one embodiment of the present disclosure.

The variable height table 10 also include a clamp 48, having a plurality of retaining notches 50 for retaining the second leg upper cross-member 32*b*, as seen in FIGS. 3-5. Preferably, the clamp 48 includes two generally parallel arms 52*a*, 52*b* each having a plurality of retaining notches 50. The retaining notches 50 of the two arms 50*a*, 50*b* are arranged in corresponding pairs. The clamp 48 may be pivotably connected to the lower surface 16 of the table top 12 by a rod 54 which passes through the clamp 48 and which is fastened to the underside of the table top 12. A spring 56 may also be included to bias the clamp 48 against the lower surface 16 of the table top 12.

The second leg 24 is removably held in place by inserting the cross-member 32*b* of the second leg 24 into one of the pairs of retaining notches 50, with the spring 56 holding the clamp 48 against the table top 12 so as to secure the second cross-member 32*b* in the retaining notches 50.

A handle 58, connected to the rod 54, allows the clamp 48 to be pivoted away from lower surface 16 of the table top 12, in order to allow the second leg cross-member 32*b* to be removed from the retaining notches 50.

In use, movement of the table's second leg upper cross-member 32*b* from a first of the retaining notches 50 to a second of the retaining notches 50 causes the legs 22, 24 to pivot relative to one another. This in turn causes the table top 12 to move from a first upright position, having a first tabletop height, to a second upright position, having a second tabletop height. Thus, the table 10 may for instance vary from a first use height of about 23 inches to a second use of height of about 25 inches. Additional tabletop heights may also be provided by providing further retaining notches 50 in the clamp 48.

By providing a plurality of table top heights in this manner, a single personal table may be used for a variety of tasks, each of which may be best accomplished by a table top of a different height. For instance, the same personal table may be useful for eating, reading, writing, or working with a computer. Moreover, the same table may be adapted for personal use by multiple persons of different heights.

The table 10 of the present disclosure may also be folded away for storage when not in use. The table 10 is folded by first removing the table's second leg upper cross-member 32*b* from all of the retaining notches of the clamp and second removing the ends of the second cross-member 32*b* from the sliding tracks 38 via the gaps 40. The legs 22, 24 of the table base assembly may then be collapsed into a folded position, so that table 10 folds nearly flat for storage.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A variable height table, comprising:

a table top having an upper surface and a lower surface and a table top height;

a pair of tracks attached to the lower surface of the table top, each of the tracks having a gap;

a scissor-folding table base assembly including a first leg and a second leg, the first and second legs each having an elongate diagonal member, an upper cross-member attached to a first end of the elongate diagonal member, and a lower foot member attached to a second end of the elongate diagonal member, wherein the first leg upper cross-member is fixedly rotatably connected to the lower surface of the table top, the second leg upper cross-member having ends which are slidably retained within the pair of tracks adjacent the lower surface of the table top, and the first and second legs are pivotably connected to one another, at a position on each leg between the first and the second ends of the legs, so as to form an X-shape; and a clamp, having a plurality of retaining notches for retaining the second leg upper cross-member, and biased against the lower surface of the table top by a spring, wherein the ends of the second leg upper cross-member may be inserted or removed from the pair of tracks through the gaps in the tracks, and wherein movement of the second leg upper cross-member from a first of the retaining notches to a second of the retaining notches causes the legs to pivot relative to one another and varies the table top height from a first height to a second height.

2. The variable height table of claim 1, wherein the table top comprises a blow-molded plastic member.

3. The variable height table of claim 1, wherein the table top upper surface has a D-shape.

4. The variable height table of claim 1, wherein each foot member includes a first end and a second end and is attached to the diagonal member only at the first end of the foot member.

5. The variable height table of claim 1, wherein each foot member includes a first end and a second end and is attached to the diagonal member at a point located between the two ends of the foot member.

6. The variable height table of claim 1, wherein the first and second legs are each formed from tubular metal.

7. The variable height table of claim 1, wherein the foot members each have a width which is greater than the width of the tabletop.

8. The variable height table of claim 1, wherein the first leg is fixedly rotatably connected to the lower surface of the table top by one or more retainers which are molded into the lower surface of the table top.

9. The variable height table of claim 1, wherein the first leg is fixedly rotatably connected to the lower surface of the table top by one or more retainer brackets which are fastened to the lower surface of the table top.

10. A folding table, movable between a folded position and a plurality of upright positions, each upright position corresponding to a different table height, a table top having an upper surface and a lower surface and table top height;

a pair of tracks attached to the lower surface of the table top, each of the tracks having a gap;

a scissor-folding table base assembly including a first leg and a second leg, the first and second legs each having an elongate diagonal member, an upper cross-member attached to a first end of the elongate diagonal member, and a lower foot member attached to a second end of the elongate diagonal member, wherein the first leg upper cross-member is fixedly rotatably connected to the lower surface of the table top, the second leg upper cross-member having ends which are slidably retained within the pair of tracks adjacent the lower surface of the table top, and the first and second legs are pivotably connected to one another, at a position on each leg between the first and the second ends of the legs; and a clamp, having a plurality of retaining notches for retaining the second leg upper cross-member, and biased against the lower surface of the table top by a spring, wherein the ends of the second leg upper cross-member may be inserted or removed from the pair of tracks through the gaps in the tracks, and wherein movement of the second leg upper cross-member from a first of the retaining notches to a second of the retaining notches causes the table to move from a first upright position, having a first tabletop height, to a second upright position, having a second tabletop height, and wherein removal of the second leg upper cross-member from all of the retaining notches allows the legs of the table base assembly to collapse into a folded position.

11. The variable height table of claim 10, wherein the table top comprises a blow-molded plastic member.

12. The variable height table of claim 10, wherein the table top upper surface has a D-shape.

13. The variable height table of claim 10, wherein each foot member includes a first end and a second end and is attached to the diagonal member only at the first end of the foot member.

14. The variable height table of claim 10, wherein each foot member includes a first end and a second end and is attached to the diagonal member at a point located between the two ends of the foot member.

15. The variable height table of claim 10, wherein the first and second legs are each formed from tubular metal.

16. The variable height table of claim 10, wherein the foot members each have a width which is greater than the width of the tabletop.

17. The variable height table of claim 10, wherein the first leg is fixedly rotatably connected to the lower surface of the table top by one or more retainers which are molded into the lower surface of the table top.

18. The variable height table of claim 10, wherein the first leg is fixedly rotatably connected to the lower surface of the table top by one or more retainer brackets which are fastened to the lower surface of the table top.

* * * * *